US006473971B2

(12) United States Patent
Ordaz

(10) Patent No.: US 6,473,971 B2
(45) **Date of Patent: *Nov. 5, 2002**

(54) DISPOSABLE MUSTACHE AND BEARD STYLIZING RAZOR

(76) Inventor: Alonso Rochin Ordaz, P.O. Box 2149, Nogales, AZ (US) 85628

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/271,125

(22) Filed: Mar. 17, 1999

(65) Prior Publication Data

US 2001/0003868 A1 Jun. 21, 2001

(51) Int. Cl.[7] ..... B26B 21/14; B26B 21/52

(52) U.S. Cl. ..... 30/47; 30/32; 30/527

(58) Field of Search ..... 30/32, 47, 51, 30/52, 57, 526, 527, 530, 532, 533, 62

(56) References Cited

U.S. PATENT DOCUMENTS

| | | | | | |
|---|---|---|---|---|---|
| 843,148 | A | * | 2/1907 | Jackson | 30/32 X |
| 855,608 | A | * | 6/1907 | Ballreich | 30/32 X |
| 865,747 | A | | 9/1907 | Arnold et al. | |
| 879,611 | A | | 2/1908 | Ebner | |
| 915,989 | A | | 3/1909 | Moore | |
| 1,262,073 | A | | 4/1918 | McCain | |
| 1,393,700 | A | | 10/1921 | Reboul | |
| 1,490,458 | A | | 4/1924 | Fairweather et al. | |
| 1,548,164 | A | * | 8/1925 | Parker | 30/32 X |
| 1,652,685 | A | * | 12/1927 | Schick | 30/47 |
| 1,735,751 | A | | 11/1929 | Green | |
| 1,878,475 | A | | 9/1932 | Driest | |
| 1,976,987 | A | * | 10/1934 | Gardner et al. | 30/32 X |
| 2,068,380 | A | | 1/1937 | Grath | |
| 2,391,606 | A | | 12/1945 | Warner | |
| 2,669,017 | A | | 2/1954 | Seko | |
| 2,676,397 | A | * | 4/1954 | DeBacco et al. | 30/47 |
| 2,741,028 | A | | 4/1956 | Carter | |
| 2,794,246 | A | | 6/1957 | Marsh et al. | |
| 2,799,927 | A | | 7/1957 | Beham | |
| 2,800,713 | A | * | 7/1957 | Roth | 30/47 X |
| 2,837,820 | A | | 6/1958 | Ostrowski | |
| 2,930,120 | A | | 3/1960 | Sherosky | |
| 3,409,982 | A | | 11/1968 | Baker et al. | |
| 3,583,262 | A | * | 6/1971 | Mullen | 30/32 X |
| 3,967,375 | A | | 7/1976 | Hoffschmidt | |
| 3,975,820 | A | | 8/1976 | Torance | |
| 4,027,386 | A | | 6/1977 | Spinosa et al. | |
| 4,245,389 | A | | 1/1981 | Trotta | |
| 4,476,630 | A | | 10/1984 | Byrne | |
| 4,622,742 | A | | 11/1986 | Lee | |
| 4,984,364 | A | | 1/1991 | Simmons | |

* cited by examiner

*Primary Examiner*—Clark F. Dexter
(74) *Attorney, Agent, or Firm*—Michael I Kroll

(57) ABSTRACT

A disposable mustache and beard stylizing razor (10) is disclosed by the present invention. The disposable mustache and beard stylizing razor (10) includes an elongate head (12) having a front end (16) and a slot (14) extending inwardly from the front end (16). A razor blade (18) having a front cutting edge (20) and a back edge (42) is releasably secured within the slot (14) when it is desired to shave. The blade (18) is releasably secured within the slot (14) in the elongate head (12) so that preferably substantially fifty percent of the blade (18) will extend outwardly from the elongate head (12), allowing a person using the razor (10) to have a complete view of the front cutting edge (20) of the blade (18) thereby permitting better shaving of a mustache, neck and sides of a face of the person.

8 Claims, 3 Drawing Sheets

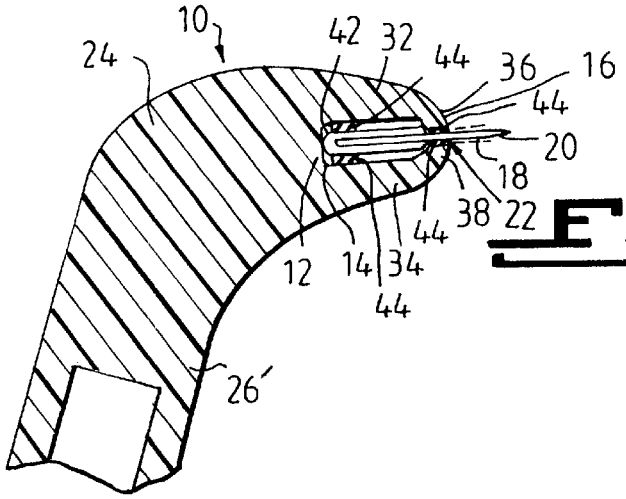
Fig. 4a
Fig. 5
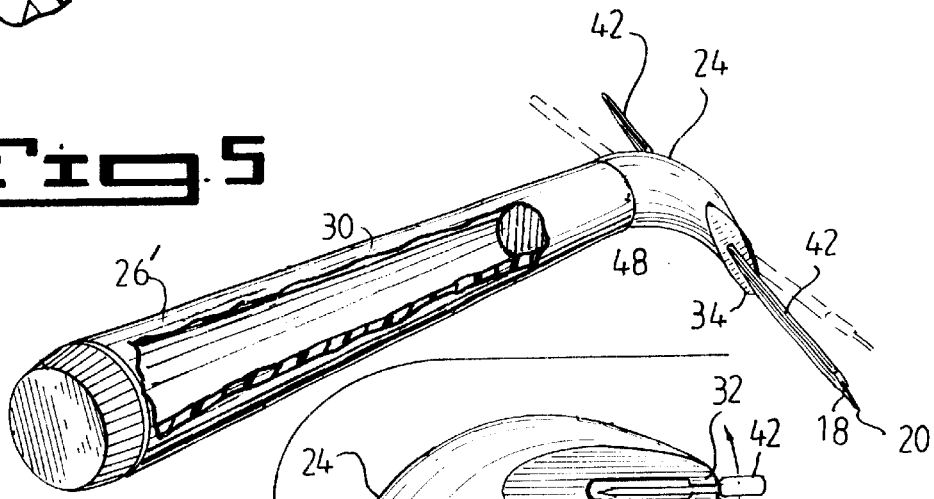
Fig. 6
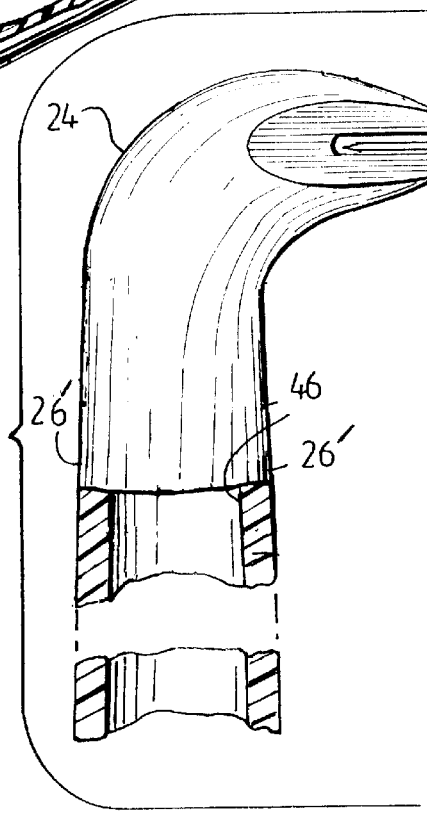

DISPOSABLE MUSTACHE AND BEARD STYLIZING RAZOR

BACKGROUND OF THE INVENTION

1. Field of the Invention

The instant invention relates generally to shaving devices and, more specifically, to a disposable stylizing razor for shaving the facial skin, e.g. a mustache or beard of a user.

2. Description of the Prior Art

Numerous shaving devices have been provided in the prior art that contain blades to cut or shave hair off of the skin of a user. For example, U.S. Pat. Nos. 1,262,073; 3,674,267; 3,967,375; 3,975,820; 4,245,389; and 4,984,364 all are illustrative of such prior art. While these units may be suitable for the particular purpose to which they address, they would not be as suitable for the purposes of the present invention as heretofore described.

U.S. Pat. No. 1,262,073

Inventor: E. L. McCain

Issued: Apr. 9, 1918

This invention relates to safety razors and aims to furnish the usual and well known type of blade handle with a novel blade holding arm for a single or double edge blade that may be stropped, honed or sharpened similar to the ordinary jack-knife razor. In this connection, the safety razor may be manipulated similar to an ordinary jack-knife razor, but with a greater degree of safety should the user of the razor desire to equip the blade holding arm with a blade guard.

U.S. Pat. No. 3,674,267

Inventor: James E. Hollis

Issued: Jul. 4, 1972

A grip for the elongated handle of a game device, such as a racket or golf club, which may be interchanged with other grips to provide different hand engaging diameters, all of the grips telescopingly fitting the shank of the handle on which it is assembled, the grip being positioned on the shank in various positions lengthwise of the shank to vary the effective length of the handle.

U.S. Pat. No. 3,967,375

Inventor: Edward J. Hoffschmidt

Issued: Jul. 6, 1976

The invention contemplates a razor-handle construction of such elemental simplicity as to be fabricated as a single integral molded-plastic part, with end-lug formations contoured to removably receive and assemble to the central region of the back-edge of certain razor blade subassemblies, including presently commercial subassemblies. In the disclosed embodiments, the handle is a sheath in which the razor-blade subassembly is self-packaged and readily accessible for assembly to the lug formations, being then correctly oriented for use.

U.S. Pat. No. 3,975,820

Inventor: William Robert Lincoln Torrance

Issued: Aug. 24, 1976

The specification discloses a razor assembly comprising a handle having a yoke-shaped extension therein into which a double-edged and double-sided blade cartridge interfits for rotatable positioning between the yoke. An ejector and stop means is located at the base of the yoke to hold the blade cartridge in one of two shaving positions with an ejector actuation means operable from the handle of the razor.

U.S. Pat. No. 4,245,389

Inventor: Robert A. Trotta

Issued: Jan. 20, 1981

A razor including a grip portion and a head portion, the head portion including a base portion extending transversely of the grip portion and a cap portion overlying and spaced from the base portion to form a cavity therebetween adapted to receive a shaving unit, a spring member fixed to the grip portion, the spring member having a cam portion adapted to extend into the cavity, the spring member cam portion being adapted to engage an underside of the shaving unit when the shaving unit is disposed in the cavity, and a button fixed to the spring member and operative, upon having pressure applied thereto by an operator, to remove the spring member cam portion from the cavity and from engagement with the shaving unit, to free the shaving unit for removal from the cavity.

U.S. Pat. No 4,984,364

Inventor: Richmond R. Simmons

Issued: Jan. 15, 1991

A perforated partition is mounted in a disposable razor head housing in angular relation to the blade, thereby defining with the housing a refrigerant-receiving chamber disposed in surrounding relation to the blade. A wall is mounted in the housing in spaced, parallel relation to the perforated partition to define an expansion chamber. One or more capped ports are provided in the housing to introduce a refrigerant which is a non-toxic freezable solution typically used to cool lunch boxes.

SUMMARY OF THE INVENTION

The present invention relates generally to shaving devices and, more specifically, to a disposable mustache and beard stylizing razor.

A primary object of the present invention is to provide a disposable mustache and beard stylizing razor that will overcome the shortcomings of the prior art devices.

A further object of the present invention is to provide a mustache and beard stylizing razor that includes an integrally formed one-piece handle and neck section.

A further object of the present invention is to provide a mustache and beard stylizing razor that includes a retaining section within the head and a clip for releasably securing a razor blade therein.

A further object of the present invention is to provide a mustache and beard stylizing razor wherein the razor blade is releasably secured within the head and extends perpendicular to the handle.

Another object of the present invention is to provide a disposable mustache and beard stylizing razor in which fifty percent of the blade extends outwardly from a retaining section in the head, so that a person using the razor will have a complete view of the cutting edge of the blade to permit better shaving of the mustache, the neck and sides of the face.

A further object of the present invention is to provide a disposable mustache and beard stylizing razor that is simple and easy to use.

A still further object of the present invention is to provide a disposable mustache and beard stylizing razor that is economical in cost to manufacture.

Further objects of the invention will appear as the description proceeds.

A disposable mustache and beard stylizing razor is disclosed by the present invention. The disposable mustache and beard stylizing razor includes an elongate head having a front end and a slot extending inwardly from the front end; and a rectangular blade having a front cutting edge and a back edge terminating within the slot. The blade is secured within the slot in the elongate head so that approximately fifty percent of the blade will extend outwardly from the elongate head, allowing a person using the razor to have a complete view of the front cutting edge of the blade thereby permitting better shaving of a mustache, neck and sides of a face of the person. The blade is secured within the slot by first and second clamp jaws defining opposing sides of the slot, each of the first and second clamp jaws retain the blade therebetween. A curved neck is affixed to the elongate head, so that the elongate head is transversely positioned with respect to the curved neck and extending outwardly therefrom. A handle is integrally connected tot he head and extends downwardly therefrom and perpendicular thereto. The handle includes a plurality of spaced apart annular ridges on its outer surface for enabling the handle to be securely gripped when in use by the person using the razor. The elongate head, curved neck, and handle may be integrally formed defining a one-piece unit.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 1:
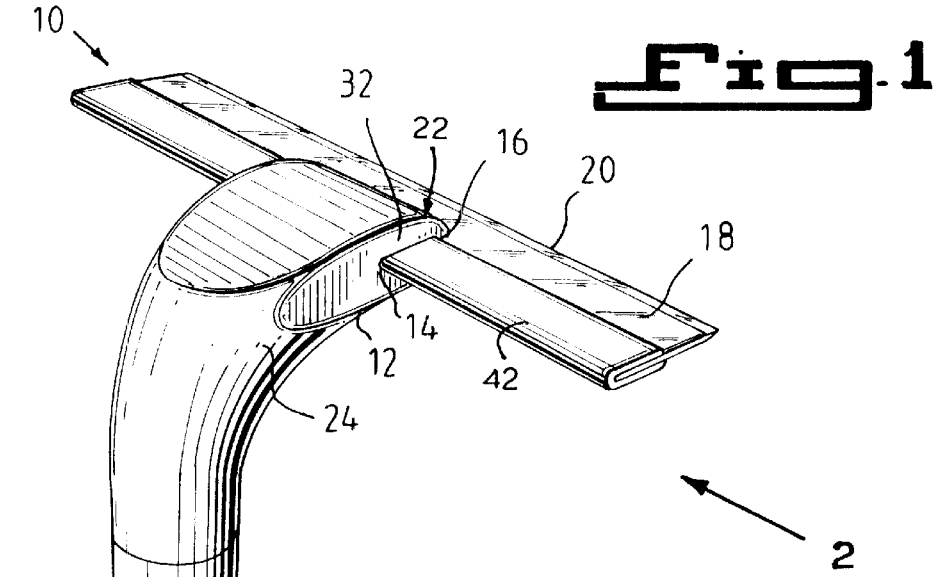
FIG. 1 is a front perspective view of the disposable mustache and beard stylizing razor of the present invention.

FIG. 4*a* is a cross sectional view of the head and razor blade of the disposable mustache and beard stylizing razor of the present invention wherein the handle is hollow;

FIG. 5 is a rear perspective view in partial cross-section of the disposable mustache and beard stylizing razor of the present invention; and FIG. 6 is a side view in partial cross-section of the disposable mustache and beard stylizing razor of the present invention.

DETAILED DESCRIPTION OF THE PREFERRED EMBODIMENT

Turning now descriptively to the drawings, in which similar reference characters denote similar elements throughout the several views, FIGS. 1 through 6 illustrate a disposable mustache and beard stylizing razor in accordance with the present invention and indicated generally by the numeral 10.

The disposable mustache and beard stylizing razor 10 includes an elongate head 12 having a slot 14 extending inwardly from a front end 16 thereof forming a securing structure 22 for retaining a razor blade 18 therein as is illustrated in FIG. 1. Extending from and perpendicular to the elongate head 12 is a handle 26. An angled neck portion 24 connects the elongate head 12 and the handle 26. The angled neck portion 24 and handle 26 are integrally formed to define a one piece unit. Alternatively, the elongated head 12 and handle 26 may be formed of separate pieces in which case the elongate head 12 may be securely fastened to the angled neck portion 24 of the handle 26. The elongated head 12 and handle portion 26 are preferably made of plastic or a synthetic resin material. However, any polymeric material, wood, steel, iron, any alloy thereof, or any combination thereof may be used to produce the elongated head 12 and handle portion 26. Furthermore, the handle portion 26 may be hollow through at least two-thirds (⅔) of its length as will be discussed with specific reference to FIGS. 4*a,* 5 and 6.

Figure 2:
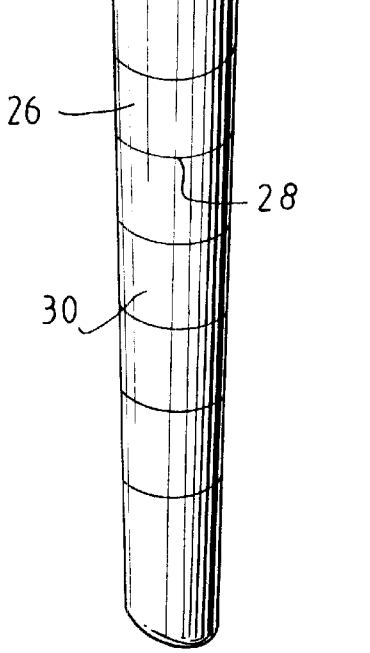
FIG. 2 is a side view of the disposable mustache and beard stylizing razor of the present invention.
Figure 2:
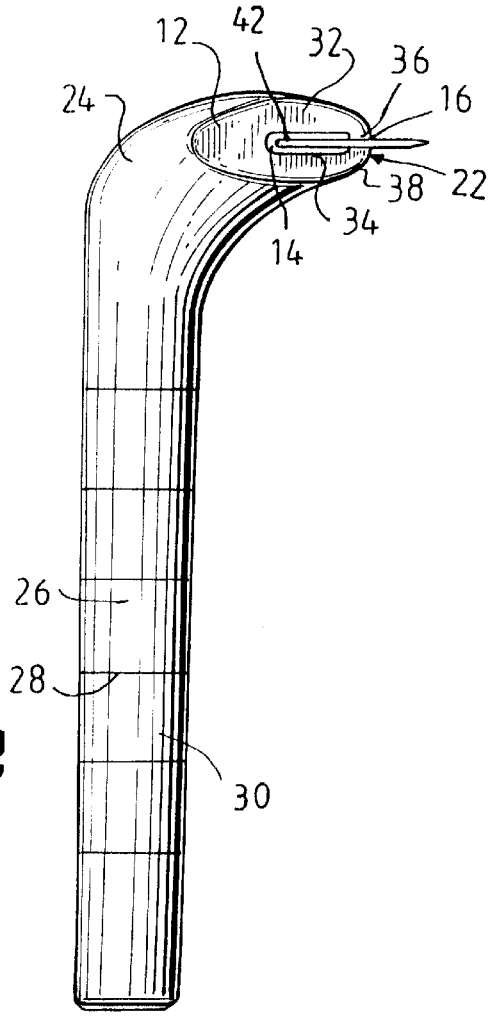
Figures 3, 4:
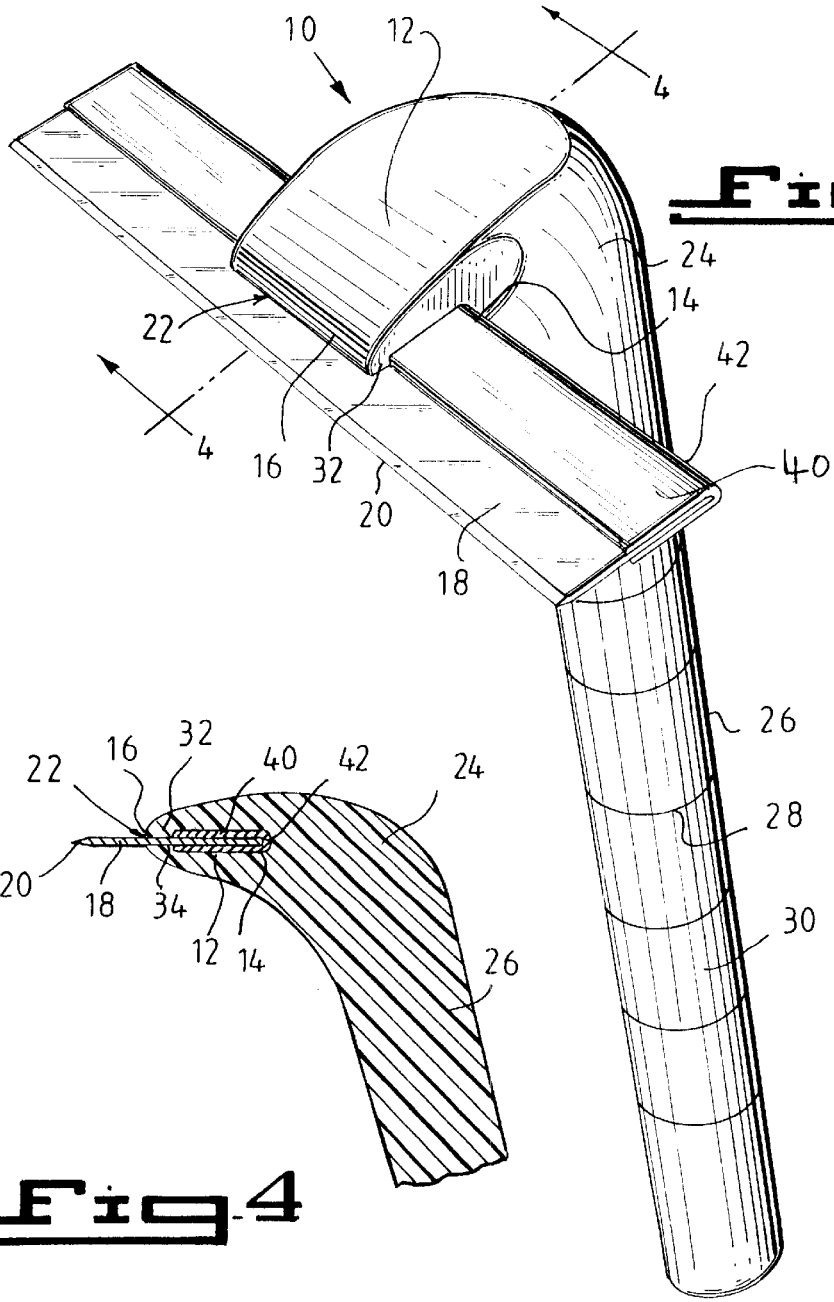
FIG. 3 is a top perspective view of the disposable mustache and beard stylizing razor of the present invention.
FIG. 4 is a cross sectional view of the head and razor blade of the disposable mustache and beard stylizing razor of the present invention taken along line 4—4 in FIG. 3.

The slot 14 within the elongate head 12 includes first and second clamp jaws 32 and 34 with opposing teeth 36 and 38 extending from each jaw 32 and 34 as can be seen from FIGS. 2 and 3. The razor blade 18 is fabricated out of a durable metal material 36 and includes a front cutting edge 20. In practice any conventional razor blade 18 may be utilized as long it is able to be secured between the clamping jaws 32 and 34. The razor blade 18 is releasably secured between the first and second clamp jaws 32 and 34 by the opposing teeth 36 and 38 and thereby positioned within the slot 14 in the elongate head 12. When correctly positioned within the slot 14, approximately fifty percent of the razor blade 18 will extend outwardly from the elongate head 12 allowing a person using the razor 10 to have a complete view of the front cutting edge 20 of the blade 18. This permits a better shaving of a mustache, neck and sides of a face of the person.

The curved neck portion 24 is affixed to the elongate head 12, so that the elongate head 12 is transversely positioned with respect to the curved neck portion 24 and extends outwardly therefrom. The handle 26 is connected to and extends downwardly from the curved neck portion 24 and at a right angle to the elongate head 12 so that the handle 26 can be gripped by the person using the razor 10. The handle 26 includes a plurality of spaced apart annular ridges 28 thereabout on its outer surface 30, to enable the handle 26 to be securely gripped when in use.

Positioned within and covering a surface of the slot 14 of the elongate head 12 is a resilient material 40 as illustrated in FIG. 4. A back side 42 of the razor blade 18 is received within the slot and between the folded surface of the resilient material 40 when the razor blade 18 is inserted into the slot 14. This stabilizes the blade 18 within the elongate head 12 while allowing for limited pivotal movement of the blade 18 within the slot 14 when a pressure is applied such as by sliding the razor blade 18 along the face of the user during shaving. The resilient material 40 may be made of rubber or any other polymeric material which may be positioned within the slot 14 and act to retain the razor blade 18 therein while permitting limited pivotal movement on the part of the razor blade 18 during a shaving operation.

FIG. 4*a* shows a cross-section of the head 12 including an alternate form for the resilient material. Alternatively, the resilient material may be in the form of pads 44 positioned within the slot 14 and covering only a portion of the entire surface of the slot 14. This figure illustrates the positioning of the pads 44 at a front end and back end of the slot 14. However, the pads 44 may be positioned anywhere within the slot 14 as long as they are able to retain the razor blade 18 within the slot 14 while permitting a limited amount of pivotal movement.

FIGS. 4*a,* 5 and 6 illustrate the disposable mustache and beard stylizing razor 10 including a hollow handle 26'. FIG. 5 illustrates a back perspective view with the handle 26' being illustrated in partial cross section to show that the handle 26' is hollow inside and includes an surface 46 defining the inner side. The use of a hollow handle 26' substantially decreases the weight of the disposable mustache and beard stylizing razor 10 and thus makes the razor 10 easier to use and store. Also illustrated in FIG. 5 and indicated by dashed lines is the ability of the razor blade 18 to pivot within the slot 14. The razor blade 18 is able to pivot due to the pliability of the material 44 positioned within the slot 14. When a pressure is applied to the razor blade 18 such as when shaving the blade will be caused to pivot and thereby relieve some of the applied pressure. This will ease the stress applied to the razor blade 18 and thereby increase its natural lifetime.

Even though a person can have a complete shave with the razor 10 if they are careful enough, the main function of the razor 10 is to finish the job after shaving with a regular razor. The invention will cut hair that is not cut by the regular razor, so that it will service as a magnificent mustache and beard stylizing razor 10.

The operation of the disposable mustache and beard stylizing razor 10 will now be discussed. In use, the razor blade 18 is positioned within the slot 14. When positioned within the slot 14, the user must be sure that the clamping jaws 32 and 34 securely retain the razor blade 18 therebetween so that there is minimal possibility of the blade falling out during shaving. The disposable mustache and beard stylizing razor 10 is now ready for use.

The user must now lather the hairs on the skin to be cut. Once lathering is complete, the user grasps the handle 26' by the hand and positions the front cutting edge 20 of the blade 18 in close proximity to the skin, so that the cutting edge 20 can be completely seen by the person using the razor 10. The front cutting edge 20 of the blade 18 is then moved along the skin to cut the hairs away from the skin. The razor blade 18 is then rinsed with water and the blade 18 is again moved along the skin to cut the hairs until the desired amount of hair is removed. Once finished, the razor blade 18 can be removed from its position between the clamping jaws 32 and 34 and turned around. The cutting edge 20 of the razor blade 18 may now be inserted between the clamping jaws 32 and 34 and secured therebetween. The securing of the razor blade 18 in this manner prior to storing will minimize the possibility of subsequent users cutting themselves on an exposed razor blade 18.

From the above it is evident that the a disposable mustache and beard stylizing razor overcomes the shortcomings of the prior art devices. The mustache and beard stylizing razor is integrally formed of a one-piece handle and neck section. The head section includes a retaining section and clip within the head for releasably securing the razor blade within the head so as to extend perpendicular to the handle. When secured within the head substantially fifty percent of the blade extends outwardly from a retaining section in the head, so that a person using the razor will have a complete view of the cutting edge of the blade to permit better shaving of the mustache, the neck and sides of the face. The disposable mustache and beard stylizing razor also includes a resilient material positioned within the clamp allowing the blade limited pivotal movement during use. Furthermore, the disposable mustache and beard stylizing razor is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A disposable mustache and beard stylizing razor, comprising:

a) a razor blade mounted in an elongate head, said razor blade including resilient material along a back side thereof, and means for releasably securing said razor blade within said head, said resilient material disposed between said razor blade and said securing means for allowing limited pivotal movement of the blade within said head when a pressure is applied during shaving, said head having a rounded front end, a slot extending inwardly from said front end receiving said razor blade, and flat sides through which said razor blade extends out the sides of said head;

b) a handle extending from said elongate head for grasping by a user during shaving, said razor blade having a length and a width, wherein about one half of said width of said blade extends uncovered outwardly from said elongate head during shaving allowing a person using said razor to have a complete view of said front cutting edge of said blade thereby permitting better shaving of a mustache, neck and sides of a face of the person, said securing means including first and second clamp jaws at the front end of said head defining opposing sides of said slot and extending towards each other at said front end of said head; and c) a curved neck affixed to said elongate head and to said handle wherein said elongate head is transversely positioned with respect to said curved neck and extends outwardly therefrom.

2. The razor as claimed in claim 1, wherein said handle is connected to extend downwardly from an end of said curved neck opposite said elongate head and perpendicular to said elongate head, said handle including a plurality of spaced apart annular ridges on an outer surface thereof for enabling said handle to be securely gripped when in use by the person using said razor.

3. The razor as recited in claim 1, wherein said slot includes an inner surface and said razor further comprises a resilient strip positioned within said slot and covering said inner surface, wherein said blade engages said resilient strip when releasably secured within said slot.

4. The razor as recited in claim 3, wherein said resilient strip is made of rubber.

5. The razor as recited in claim 4, wherein said resilient strip permits limited pivotal movement of said blade.

6. The disposable mustache and beard stylizing razor as recited in claim 1, wherein said slot includes an inner surface and said razor further comprises at least one resilient pad positioned within said slot for engaging said blade.

7. The razor as recited in claim 6, wherein said at least one resilient pad is made of rubber.

8. The disposable mustache and beard stylizing razor as recited in claim 7, wherein said at least one resilient pad permits limited movement of said blade.

* * * * *